US008517752B2

(12) United States Patent
Huang et al.

(10) Patent No.: US 8,517,752 B2
(45) Date of Patent: Aug. 27, 2013

(54) UNIVERSAL SERIAL BUS CONNECTOR

(75) Inventors: Haw-Kae Huang, Taipei Hsien (TW); Shu I Chen, Taipei Hsien (TW)

(73) Assignee: Giga-Byte Technology Co., Ltd., New Taipei (TW)

( * ) Notice: Subject to any disclaimer, the term of this patent is extended or adjusted under 35 U.S.C. 154(b) by 43 days.

(21) Appl. No.: 13/409,925

(22) Filed: Mar. 1, 2012

(65) Prior Publication Data

US 2013/0143441 A1 Jun. 6, 2013

(30) Foreign Application Priority Data

Dec. 2, 2011 (TW) ..... 100144535 A

(51) Int. Cl.
*H01R 13/64* (2006.01)

(52) U.S. Cl.
USPC ..... 439/248; 439/607.58; 439/660

(58) Field of Classification Search
USPC ..... 439/660, 247, 248, 607.58
See application file for complete search history.

(56) References Cited

U.S. PATENT DOCUMENTS 7,513,786 B2 * 4/2009 Muroi et al. ..... 439/248
7,909,629 B2 * 3/2011 Lev et al. ..... 439/247

* cited by examiner

*Primary Examiner* — James Harvey
(74) *Attorney, Agent, or Firm* — Chun-Ming Shih

(57) ABSTRACT

A universal serial bus (USB) connector includes a shell, a body and an elastic portion. The body is provided inside the shell and can be moved therein. The body includes a first conductive terminal provided on a first surface and a second conductive terminal provided on a second surface, the first surface disposed opposite to the second surface. The elastic portion is connected to both leading edges of the first surface and the second surface for keeping the body in position inside the shell.

8 Claims, 6 Drawing Sheets

UNIVERSAL SERIAL BUS CONNECTOR

CROSS-REFERENCE TO RELATED APPLICATIONS

This application claims the benefit of the filing date of Taiwan Patent Application No. 100144535, filed on 2011 Dec. 2, in the Taiwan Intellectual Property Office, the disclosure of which is incorporated herein in its entirety by reference.

BACKGROUND OF THE INVENTION

1. Field of the Invention

This invention is relative to a universal serial bus (USB) connector; in particular, relative to a USB connector which can be plugged with both sides.

2. Description of the Prior Art

Universal serial bus (USB) is a transmission protocol which is widely accepted and has been adopted recently. Since USB is characterized by high transmission rate, USB connection ports become necessary for most computers and laptops and the corresponding drivers of USB are also built in those computers and laptops in advance. Besides, because the transmission of USB can be activated by just one plug-and-play step, USB has become the transmission protocol for a variety of electronic devices, such as flash drives, portable hard drives, mp3 players or portable CD-ROM drives. In other words, the USB connector along with its transmission protocol is a must-have unit of the electronic device.

However, the common USB connector can just be plugged on one side, the body and the conductive terminal inside the connector are arranged correspondingly. If the USB connector is inserted upside down, it can not work successfully and may be even damaged. The positive side of the USB connector is usually labeled by a reminder icon to prevent the wrong insertion. But the USB ports of some electronic devices are set in a reverse direction to be complied with the layout of the internal components. Under this condition, the user cannot insert the USB connector successfully following the reminder icon, thereby causing inconvenience.

SUMMARY OF THE INVENTION

In view of the above, an object of the present invention is to provide an USB connector which can be inserted with both sides for solving the aforesaid problems of the conventional USB connector and increasing users convenience.

In one embodiment of the present invention, a universal serial bus (USB) connector includes a shell, a body and an elastic portion. The body is provided inside the shell and can be moved therein. The body includes a first conductive terminal provided on a first surface and a second conductive terminal provided on a second surface. The elastic portion is connected to both leading edges of the first surface and the second surface for keeping the body in position inside the shell.

The present invention is characterized in that the body can be led by the elastic portion to move within the shell. In addition, the first terminal and second terminal are also disposed on the two surfaces of the body respectively. Hence, the USB connector can be inserted with both sides and electrically connected to the first terminal on the first surface or the second terminal on the second surface. In this way, the users' convenience is improved and the USB connector can be protected from being inserted in a wrong direction.

Further objects, embodiments and advantages are apparent in the drawings and in the detailed description which follows.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION OF PREFERRED EMBODIMENTS

Figure 1:
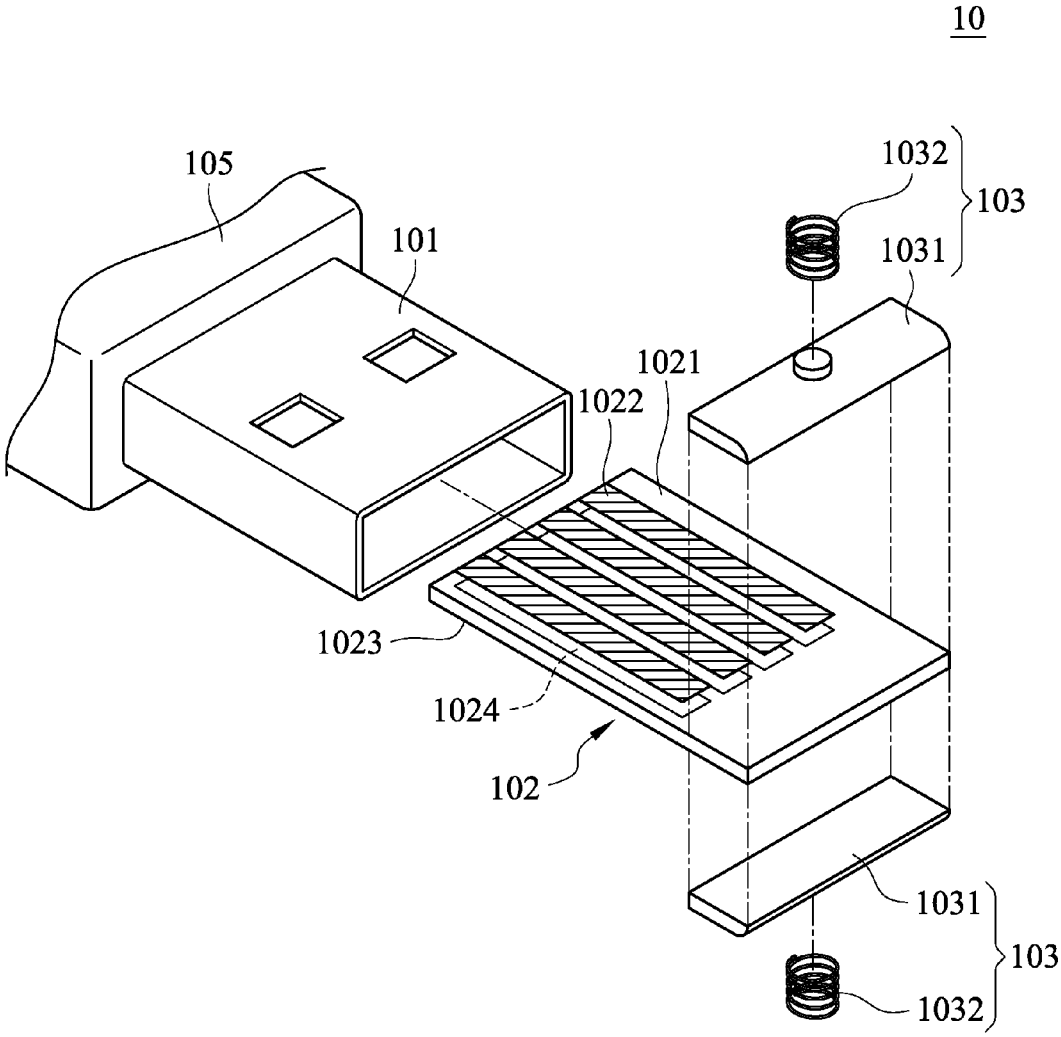
FIG. 1 illustrates an exploded view of an USB connector in the present invention.
Figure 2:
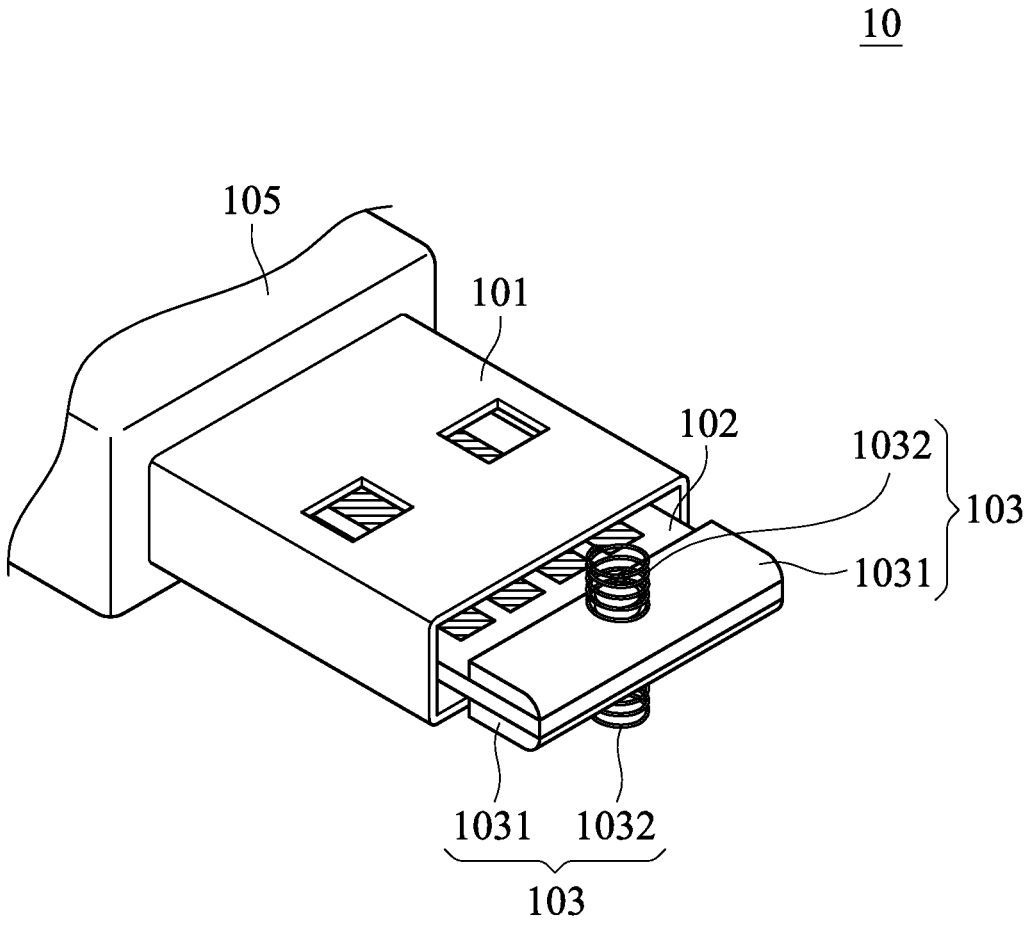
FIG. 2 illustrates a three-dimensional view of the USB connector in the present invention.
Figure 3:
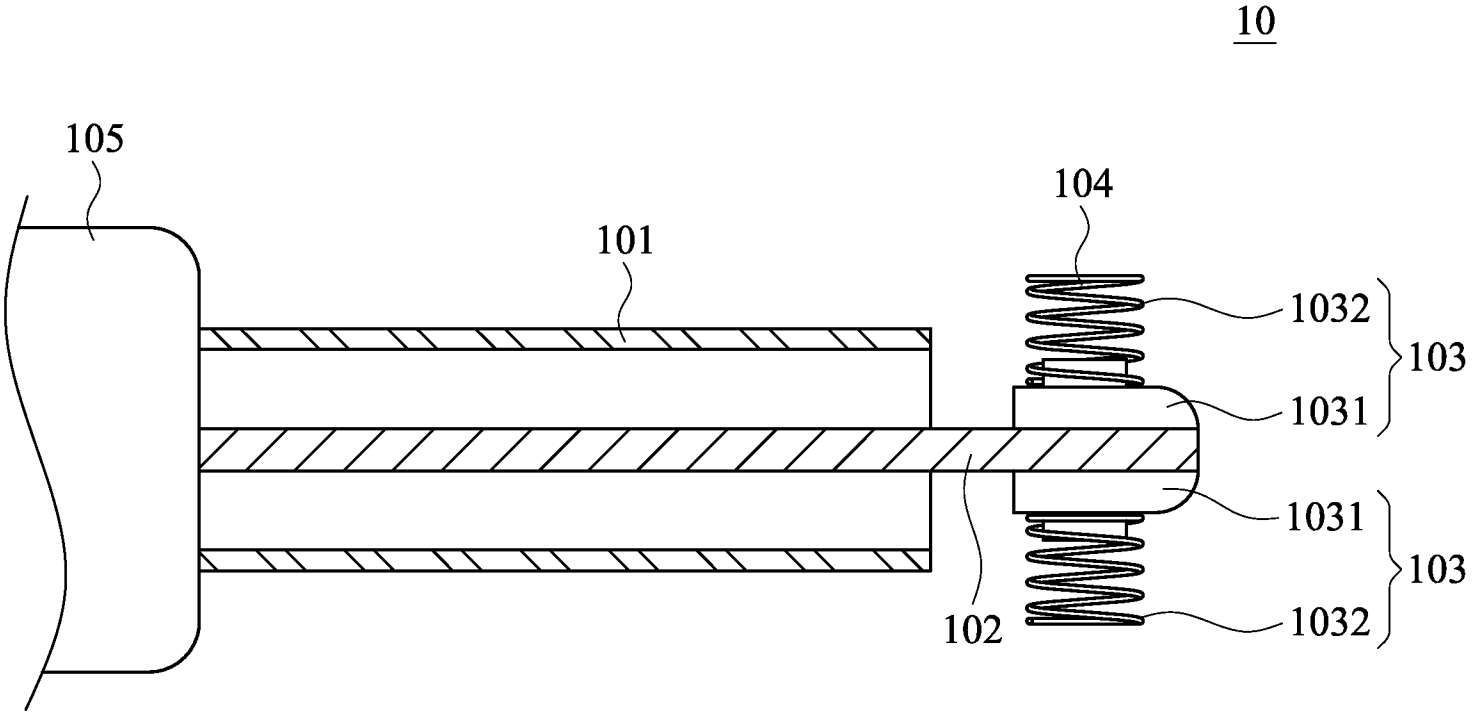
FIG. 3 illustrates a side view of the USB connector in the present invention.

Referring to the exploded view of FIG. 1, the three-dimensional view of FIG. 2 and the side view of FIG. 3, the USB connector 10 of the present invention includes a shell 101, a body 102 and an elastic portion 103. The body 102 is disposed within the shell 101 and the initial position of the body 102 is located in middle of the shell 101. The body 102 has a first surface 1021 and a second surface 1023 which are disposed on opposite side of the body 102. Also, the body 102 has a first conductive terminal 1022 and a second conductive terminal 1024. The first conductive terminal 1022 and the second conductive terminal 1024 are provided on the first surface 1021 and the second surface 1023 of the body 102 respectively. It is noted that the first conductive terminal 1022 and the second conductive terminal 1024 are configured following the technical specifications of the USB transmission protocol, and both of them can be electrically connected to USB port alternatively and operated independently. Besides, the shell 101 is made of metal while the body 102 is made of an insulating material.

In the USB connector 10 of the present invention, the elastic portion 103 is composed of two parts located on both sides of the body 102 respectively. Each of the two parts of the elastic portion 103 has a fixation piece 1031 and an elastic piece 1032. Leading edges of both fixation pieces 1031 are rounded to be an arc profile and connected to the first surface 1021 and second surface 1023 of the body 102 respectively. The elastic piece 1032 is also connected with the fixation piece 1031 and enables the body 102 to move in the space inside the shell 101. The elastic piece 1032 could be but not limited to springs, flexible foam or flexible metal strips. It is noted that one with ordinary skill in the art can employ other materials for the elastic piece 1032 as required.

Referring to FIG. 2 and FIG. 3 again, the USB connector 10 further includes an insulating shell 105. The insulating shell 105 covers the shell 101 and could be formed integrally therewith for facilitating the plug-in or pull-out of the USB connector 10.

Figure 4:
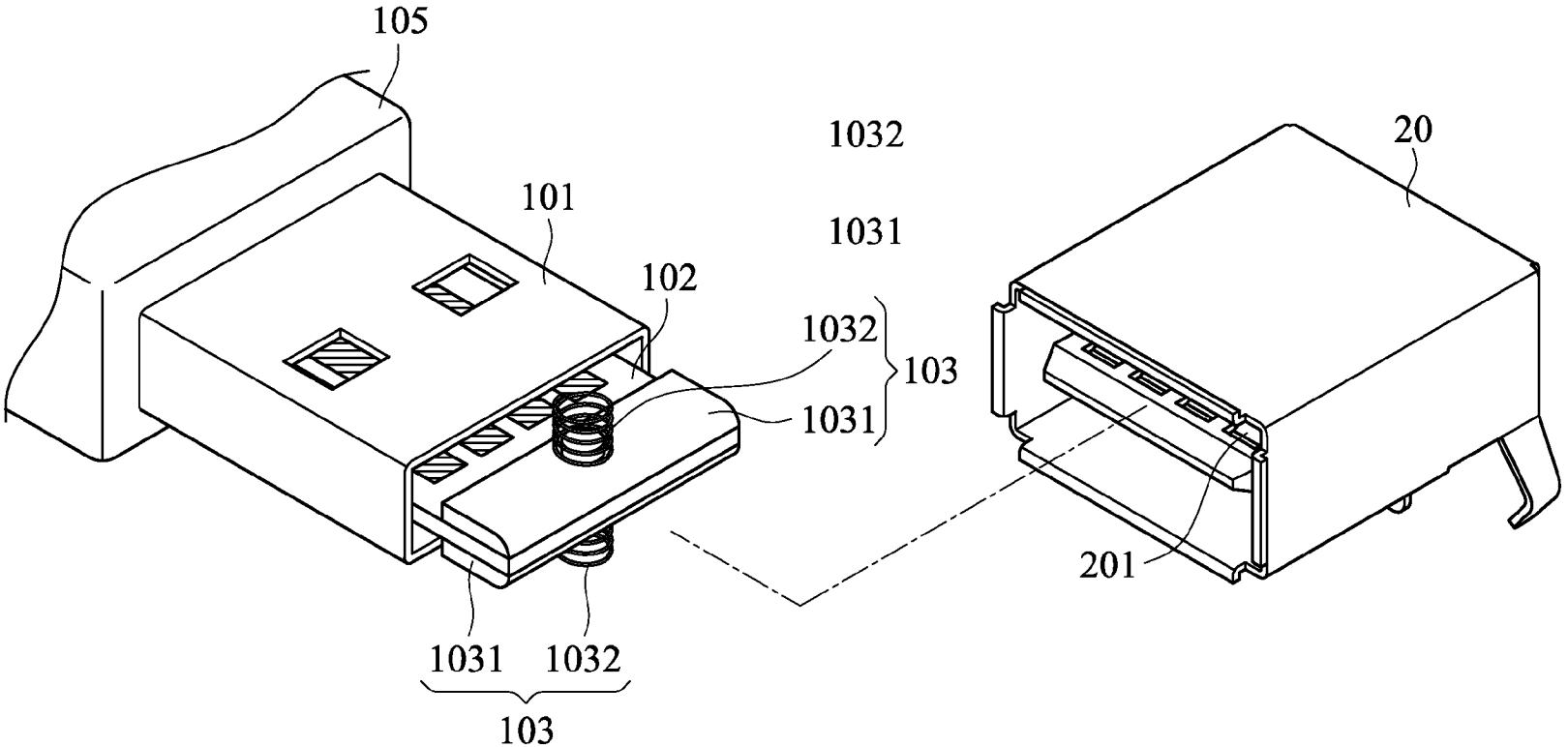
FIG. 4 illustrates a schematic view of the USB connector of the present invention when plugged into an electronic device.
Figure 5:
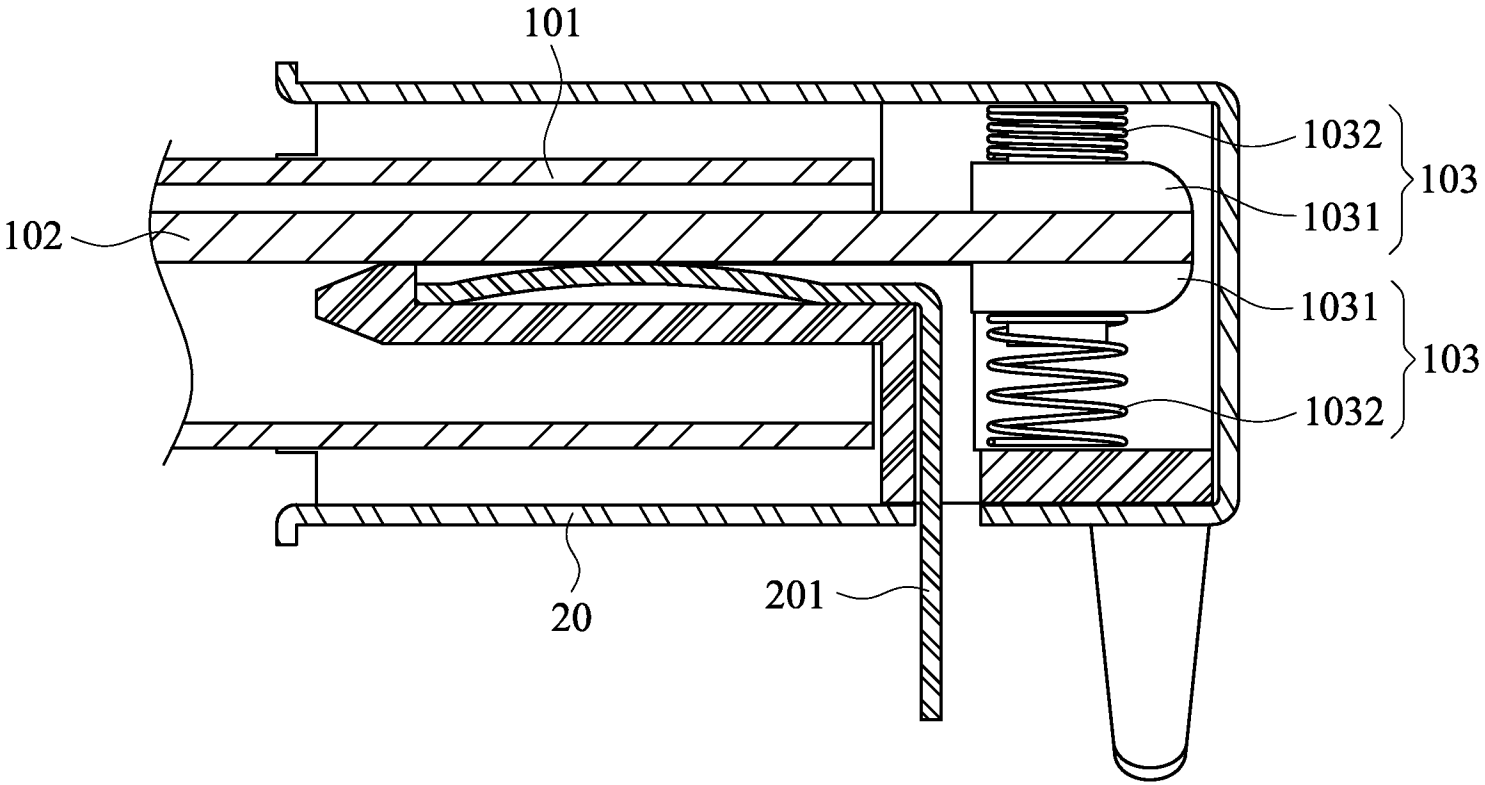
FIG. 5 illustrates a side view of the USB connector according to one embodiment of the present invention when plugged into an electronic device.

FIGS. 4 and 5 are respectively a schematic view and a side view of the USB connector according to one embodiment of the present invention when plugged into an electronic device.

Figure 6:
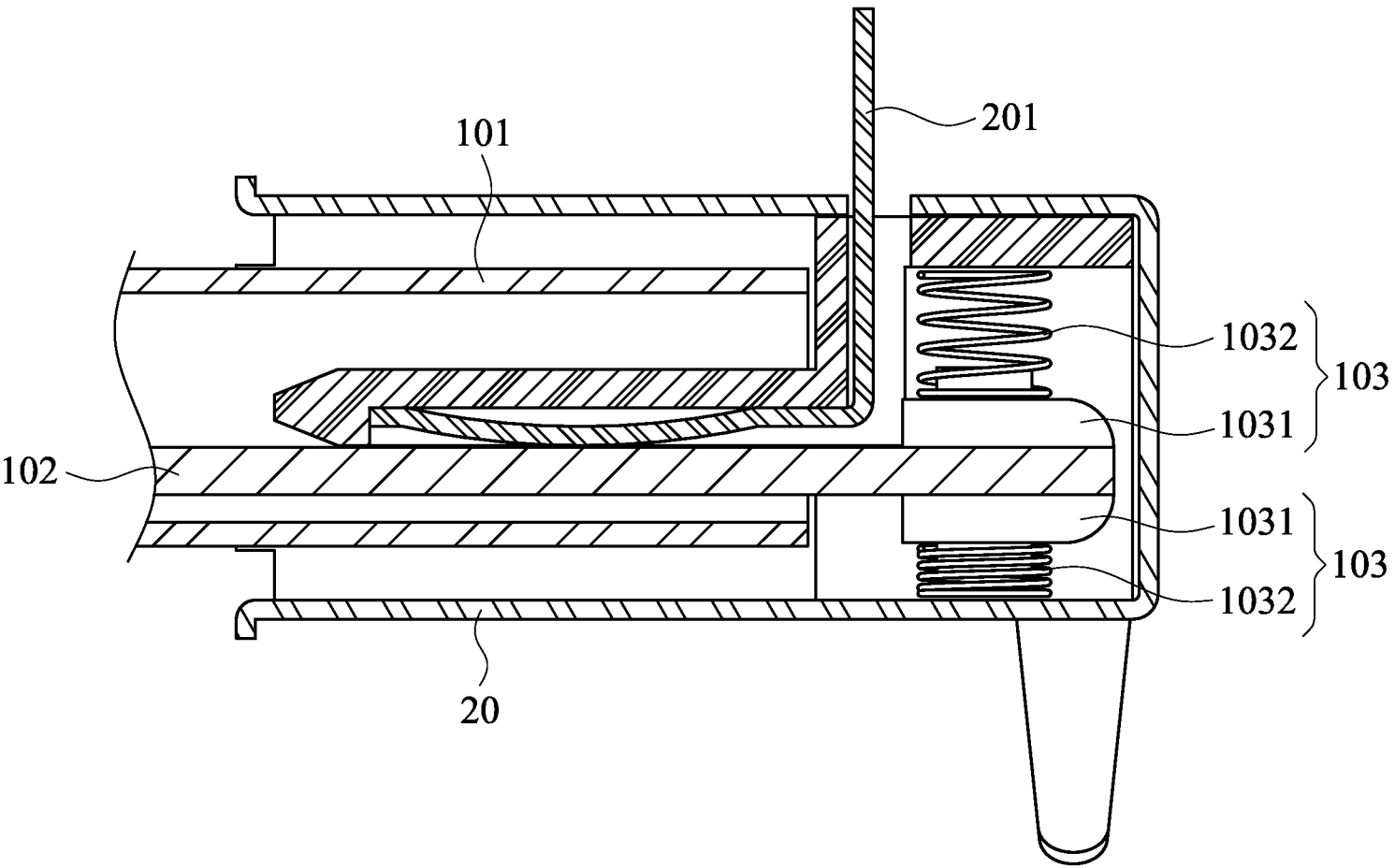
FIG. 6 illustrates a side view of the USB connector according to another embodiment of the present invention when plugged into an electronic device.

When the USB connector 10 is being inserted into the USB port 20 of an electronic device, the elastic piece 1032 and the fixation pieces 1031 located in the leading edge of the body 102 contact first with the USB port 20 through the opening as illustrated in FIG. 4. If the conductive pin 201 is provided extending to the level below the USB port 20 as illustrated in FIG. 5, the elastic piece 1032 under the body 102 will be squeezed, and then the fixation pieces 1031 and the body 102 connected with the fixation pieces 1031 will move upward in the shell 101. After the elastic pieces 1032 and the fixation pieces 1031 pass through the conductive pin 201, the elastic pieces 1032 and the fixation pieces 1031 of the body 102 will be held in position within the USB port 20 to make the second terminal 1024 on the second surface 1023 of the body 102 be electrically connected with the conductive pin 201 while the first terminal 1022 on the first surface 1021 of the body 102 will not be conductive comparatively. FIG. 6 illustrates a side view of the USB connector according to another embodiment of the present invention when plugged into an electronic device. On the contrary, if the conductive pin 201 is provided extending to the level above the USB port 20 as illustrated in FIG. 6, the elastic piece 1032 above the body 102 will be squeezed, and then the fixation pieces 1031 and the body 102 connected with the fixation pieces 1031 will move downward in the shell 101. After the elastic pieces 1032 and the fixation pieces 1031 pass through the conductive pin 201, the elastic pieces 1032 and the fixation pieces 1031 of the body 102 will be held in position within the USB port 20 to make the first terminal 1022 on the first surface 1021 of the body 102 be electrically connected with the conductive pin 201 while the second terminal 1024 on the second surface 1023 of the body 102 will not be conductive comparatively.

The USB connector of the present invention has an elastic portion and a body that can be moved up and down, thereby eliminating the concern about the plug-in direction of the USB port when connected to the electronic device. As a result, the users' convenience is significantly improved. Besides, the USB connector is protected from damage due to the incorrect insertion, which is helpful in prolonging the service life of the USB connector.

While the disclosure has been described in terms of what is presently consider to be the preferred embodiments, it is to be understood that the disclosure needs not be limited to the disclosed embodiment. On the contrary, it is intended cover various modifications and similar arrangements included within the spirit and scope of the appended claims which are to be accorded with the broadest interpretation so as to encompass all such modification and similar structures. It is therefore intended by the appended claims to define the true scope of the invention.

What is claimed is:

1. An universal serial bus (USB) connector comprising:

a shell;

a body disposed within the shell and capable of moving with respect to the shell, the body comprising a first surface and a second surface, the first surface disposed opposite to the second surface, a first conductive terminal provided on the first surface and a second conductive terminal provided on the second surface for electrical connection alternatively; and an elastic portion connected to both of the first surface and the second surface, wherein the elastic portion retains the body in position inside the shell by using spring force.

2. The USB connector according to claim 1, wherein the body is located in middle of the shell initially.

3. The USB connector according to claim 2, wherein the elastic portion further comprises a fixation piece, connected to the first surface and the second surface of the body respectively and an elastic piece connected with the fixation piece and enabling the body to move inside the shell.

4. The USB connector according to claim 3, wherein a leading edge of the fixation piece is rounded.

5. The USB connector according to claim 4, wherein the USB connector further comprises an insulating shell covering the shell integrally.

6. The USB connector according to claim 2, wherein leading edges of the first surface and the second surface are arcs and guiding the insertion of the USB connector.

7. The USB connector according to claim 6, wherein the USB connector further comprises an insulating shell covering the shell integrally.

8. The USB connector according to claim 1, wherein the shell is made of metal and the body is made of insulating material.

* * * * *